United States Patent [19]

Shekleton

[11] 3,933,133

[45] Jan. 20, 1976

[54] ROTATING CUP FUEL INJECTOR

[75] Inventor: Jack R. Shekleton, San Diego, Calif.

[73] Assignee: International Harvester Company, San Diego, Calif.

[22] Filed: Nov. 19, 1973

[21] Appl. No.: 417,456

[52] U.S. Cl. ..... 123/30 C; 60/39.74 S; 110/28 B; 123/138; 431/168

[51] Int. Cl.[2] ..... F02M 61/02

[58] Field of Search ..... 123/30 C, 119 CG, 138; 60/39.74 R, 39.74 S; 431/168; 214/18.22; 110/28 H, 28 B

[56] References Cited

UNITED STATES PATENTS

| | | | |
|---|---|---|---|
| 540,650 | 6/1895 | Eddy | 431/168 X |
| 1,468,008 | 9/1923 | Dyson | 110/28 B X |
| 1,562,799 | 11/1925 | Smith | 431/168 X |
| 2,602,292 | 7/1952 | Buckland et al. | 60/39.74 S |

FOREIGN PATENTS OR APPLICATIONS

| | | | |
|---|---|---|---|
| 1,188,845 | 9/1959 | France | 431/168 |

*Primary Examiner*—Charles J. Myhre
*Assistant Examiner*—Tony Argenbright
*Attorney, Agent, or Firm*—Matthew P. Lynch

[57] ABSTRACT

An improved fuel injector for a turbine, the injector comprising a conical cup adapted to be rotated and a means for depositing fuel on the internal surface of the cup. When the cup is rotated the fuel is caused to be spread uniformly over the internal surface of the cup as a thin film due to centrifugal force. An air blast is provided externally of the cup and parallel thereto, whereby the fuel reaching the lip of the cup is atomized and directed outwardly at a controlled spray angle. During turbine ignition an air blast is not utilized, thereby allowing a constant spray angle of 180 degrees and permitting the accurate fixed location for the ignition system.

1 Claim, 2 Drawing Figures

Fig. 1
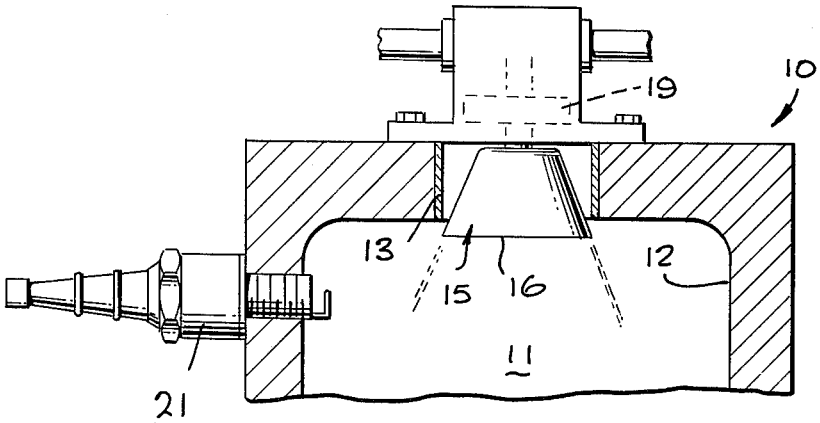
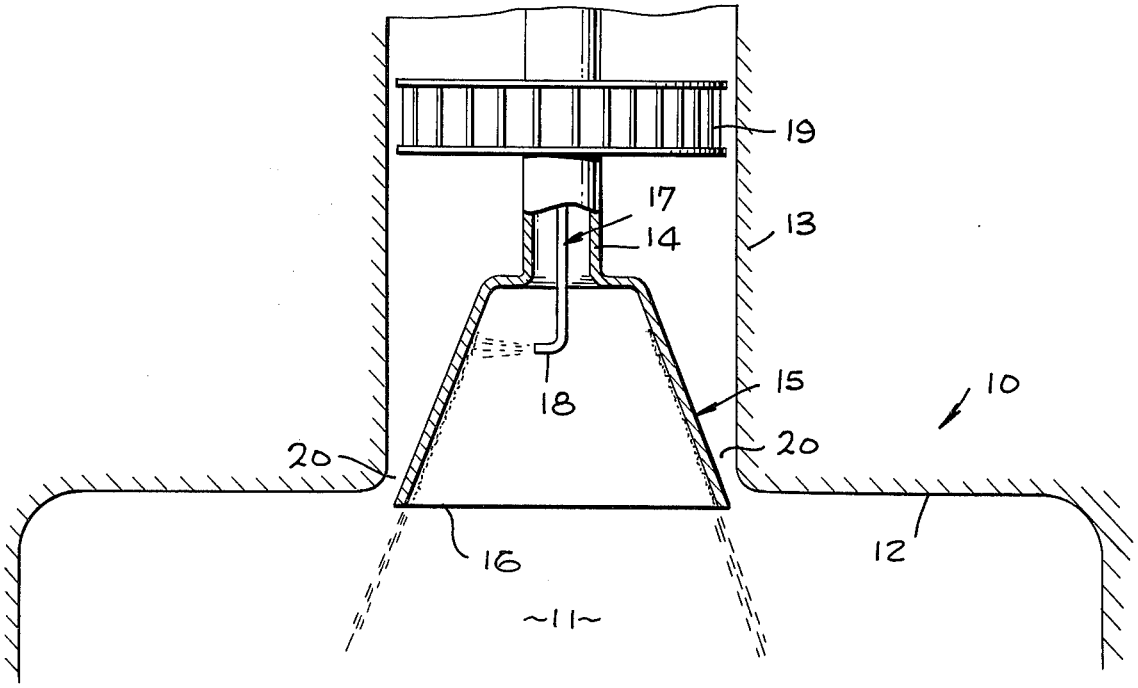
Fig. 2

ROTATING CUP FUEL INJECTOR

BACKGROUND OF THE INVENTION

Rotating cup fuel injectors have been used in industrial oil burner applications for a large number of years and have been found to give very good fuel atomization at low rates.

However, such rotating cup fuel injectors have not been utilized in gas turbines because of two major problems, namely:

large variations in spray angle makes ignition difficult and requires large diameter combustors; and flame stability is not good because of the high air velocities.

SUMMARY OF THE INVENTION

The present invention overcomes the aforementioned problems by providing a generally frusto-conical cup which is caused to rotate. Fuel is caused to be deposited in droplets on the internal surface of the rotating cup and centrifugal forces spread the fuel fairly uniformly as a film over the entire internal surface of the cup. The cup diverges outwardly as it approaches its open end. As the cup rotates, centrifugal forces drive the fuel along the expanding walls of the cup to a lip from which the fuel departs as the mass of liquid becomes sufficient, so that the constraint of surface tension becomes too small to prevent momentum forces which are very nearly tangential to the lip of the cup from moving the liquid in a straight line. If there is no externally applied air blast across the lip of the rotating cup, the fuel is caused to leave the cup in a straight line, wherein the spray angle of the fuel is 180°. During ignition the fuel is allowed to leave the cup by means of the momentum forces and therefore the ignition system can be located in a fixed position relative to the 180° spray angle of the fuel in order to facilitate ignition. Subsequent to ignition an air blast is combined with the rotating cup, whereby air is blown parallel to the axis of rotation of the cup and across the lip of the cup, thereby causing an atomization of the fuel and providing a means of controlling the spray angle of the fuel.

BRIEF DESCRIPTION OF THE DRAWINGS

FIG. 1 is a fragmentary sectional view of a portion of a turbine incorporating the invention.

FIG. 2 is an enlarged diagramatic representation of the rotating cup fuel injector.

DESCRIPTION OF THE PREFERRED EMBODIMENT

Referring now to the drawings, wherein like reference numbers designate like or corresponding parts, there is shown in FIGS. 1 and 2 a turbine 10 having a combustion chamber 11. Disposed along a wall 12 of the chamber 11 and communicating therewith is an outwardly extending annular flange 13. A hollow shaft 14 extends coaxially through the flange 13. The shaft terminates intermediate the ends of said flange 13 and has secured to the inner end thereof a frusto-conical cup 15. The cup 15 is rotatably secured to the hollow shaft 14 so that when the shaft rotates the cup also rotates. The cup 15 diverges outwardly as it approaches the chamber 11 to form an annular lip 16 at the free end of the cup 15. The lip 16 extends inwardly beyond the flange 13 into the chamber 11 for reasons hereinafter set forth.

A hollow fixed fuel tube 17 is secured within the hollow shaft 14 in coaxial relationship thereto. One end of the tube 17 is connected to a source of fuel (not shown) and the opposite end of the tube 17 has a leg 18 which depends perpendicularly from the tube 17 at a point intermediate the ends of the cup 15. The tube 17 is held in fixed relationship to the shaft 14 so that even though the shaft and the cup 15 rotate as a unit the tube 17 remains in its fixed position.

Secured to the shaft 14 behind the cup 15 within the flange 13 is a fan 19. The fan 19 is adapted to be rotated in conjunction with the shaft 14 so that when the cup 15 is rotated the fan 19 rotates at the same revolutions per minute. The purpose of the fan 19 is to generate a high velocity stream of air, which air stream is directed towards the cup 15 parallel to the axis of rotation of the cup. As will be noted from FIG. 1 the outer diameter of the cup 15 upon entering the combustion chamber 11 is slightly smaller than the inner diameter of the flange 13, thereby providing an annular throat 20 through which the air generated by the fan 19 can pass into the chamber 11. The air in passing through the throat 20 also passes over the lip 16. While a common fan 19 has been illustrated for the purpose of showing how a high velocity stream of air can be generated, it will be obvious to one skilled in the art to which this invention pertains, that there are a number of alternative methods of providing a high velocity stream of air such as compressed air or bleed air from the turbine. In some operations it would even be preferable to utilize a source of air which is independent of shaft rotation; however, for the sake of simplicity of description a fan has been utilized.

Disposed in a wall of the combustion chamber 11 complementary relationship to the lip 16 of the cup 15 is a spark plug 21 which is connected to a suitable source of power (not shown).

In the operation of the mechanism described pressurized fuel is fed through the tube 17 and then issues through the leg 18 into the cup 15. When the shaft 14 is rotated thereby causing the cup 15 to rotate centrifugal forces cause the viscous fuel to spread into a film uniformly over the internal surface of the cup. As the fuel continues to issue from the leg 18 into the cup 15, the centrifugal forces drive the fuel along the expanding walls of the cup to the lip 16 from which the fuel departs as the mass of fuel becomes sufficient, so that the constraint of surface tension becomes too small to prevent the momentum forces which are very nearly tangential to the lip of the cup from moving in a straight line. Because of the tangential forces generated as a result of the rotation of the cup, the fuel is caused to assume a constant spray angle of 180°. This is particularly true at low speeds when high velocity air is not utilized for atomization or combustion. Because of the constant spray angle of 180° for the fuel during low speed operation, without high velocity air, the ignition system can be accurately located in a fixed complementary relationship to the fuel spray angle to facilitate ignition, the spray angle being independent of fuel viscosity.

After ignition, the high velocity air stream is generated by either the fan 19 or an alternative source of air and the air stream is directed towards the combustion chamber 11, along a path that is essentially parallel to the axis of rotation of the cup 15. The air stream is caused to pass through the throat 20 and then over the lip 16 of the cup 15. Since the centrifugal forces generated by the rapidly rotating cup causes the fuel deposited within the cup to move outward along the inner surface of the cup, the fuel finally leaves the cup lip in the form of a finely atomized spray. The spray is immediately contacted by the high velocity air stream passing through the throat and they are intimately mixed together. The high velocity air stream also causes the fuel and air mixture to assume a spray angle of less than 180°. The shape of the spray angle is determined by the volume and velocity of the air stream and can be accurately controlled thereby.

From a detailed consideration of this description, it will be apparent to those skilled in the art that this invention may be employed in a number of different ways through the use of routine skill in this field. For this reason, the present invention is not to be considered as being limited except by the appended claims defining the invention.

I claim:

1. In a turbine having a combustion chamber, a variable fuel injector comprising:

an annular flange communicating with the combustion chamber;

a frusto-conical cup rotably mounted within said flange whereby the outwardly diverging end of said cup is disposed within the combustion chamber and a throat is formed between said cup and said flange;

means secured to one end of said cup and adapted to rotate said cup;

a hollow tube extending coaxially through said rotating means into said cup, the other end of said tube being disposed intermediate the ends of said cup, whereby fuel is deposited within said cup through said tube;

means for generating a high velocity air stream through the throat and over the outer lip of said cup, said air stream being substantially parallel to the axis of rotation of said cup;

an ignition means mounted within said combustion chamber in substantially normal orientation to the axis of rotation of said cup and in complementary relationship to the lip of said cup, said air generating means and said cup rotating means being operably so that when said cup is first rotated fuel on the inner surface of said cup is caused to leave said cup at a constant spray angle of 180 degrees without significant air blast to allow contact with the ignition means and, after ignition, to provide a high velocity air stream, whereby the fuel and air are intimately mixed and assume a spray angle of less than 180°.

* * * * *